US009271591B2

(12) United States Patent
Austin

(10) Patent No.: US 9,271,591 B2
(45) Date of Patent: Mar. 1, 2016

(54) KILT HANGER

(76) Inventor: Joseph E. Austin, Las Vegas, NV (US)

( * ) Notice: Subject to any disclaimer, the term of this patent is extended or adjusted under 35 U.S.C. 154(b) by 0 days.

(21) Appl. No.: 11/425,039

(22) Filed: Jun. 19, 2006

(65) Prior Publication Data

US 2008/0000935 A1 Jan. 3, 2008

(51) Int. Cl.

| | |
|---|---|
| ***A41D 27/22*** | (2006.01) |
| ***A47G 25/48*** | (2006.01) |
| ***A47G 25/28*** | (2006.01) |

(52) U.S. Cl.

CPC ..... *A47G 25/485* (2013.01); *A47G 25/28* (2013.01)

(58) Field of Classification Search

CPC ..... A47G 25/16; A47G 25/18; A47G 25/28; A47G 25/48; A47G 25/481; A47G 25/485; A47G 25/743; A47G 25/24; A47G 25/483; A47G 25/52

USPC ..... 223/85, 88, 90, 91, 92, 93, 95, 96, 223/DIG. 1, DIG. 2, DIG. 3; D6/315, 318, D6/319, 326, 328; 211/85.3, 113

See application file for complete search history.

(56) References Cited

U.S. PATENT DOCUMENTS

| | | | | | |
|---|---|---|---|---|---|
| 122,378 | A | * | 1/1872 | Gray | 211/113 |
| 511,579 | A | * | 12/1893 | Beracierto | 211/113 |
| 1,381,439 | A | * | 6/1921 | Tannenbaum | 223/89 |
| 1,421,709 | A | * | 7/1922 | Nelson | 211/119 |
| 2,191,714 | A | * | 2/1940 | Gustin | 211/119 |
| 2,439,529 | A | * | 4/1948 | Stevenson | 223/88 |
| 2,472,262 | A | * | 6/1949 | Mullen | 223/89 |
| 2,506,510 | A | * | 5/1950 | Longwell et al. | 223/91 |
| 2,561,045 | A | * | 7/1951 | Belefant | 223/88 |
| 2,577,397 | A | * | 12/1951 | Bailey | 211/118 |
| 2,598,614 | A | * | 5/1952 | Hilda | 211/113 |
| 2,601,926 | A | | 7/1952 | Speaker et al. | |
| 2,672,989 | A | * | 3/1954 | Creveling et al. | 211/113 |
| 2,675,130 | A | * | 4/1954 | Dore | 211/118 |
| 2,920,800 | A | * | 1/1960 | Kassardjian | 223/88 |
| 3,157,325 | A | * | 11/1964 | Schaefer | 223/91 |
| 3,203,061 | A | * | 8/1965 | Thomas | 24/338 |
| D206,300 | S | * | 11/1966 | Moses | D6/319 |
| 3,352,430 | A | * | 11/1967 | McAtee | 223/96 |
| 3,565,261 | A | * | 2/1971 | Recla et al. | 223/85 |
| 4,160,516 | A | * | 7/1979 | Rice | 223/98 |
| D253,448 | S | * | 11/1979 | Salladay | D6/319 |

(Continued)

FOREIGN PATENT DOCUMENTS

| | | | | |
|---|---|---|---|---|
| EP | 0229366 | A1 | 12/1985 | |
| EP | 1338227 | A2 * | 8/2003 | A47G 25/30 |

(Continued)

*Primary Examiner* — Nathan Durham
(74) *Attorney, Agent, or Firm* — Greenberg Traurig, LLP

(57) ABSTRACT

A kilt hanger for accommodating a kilt and kilt accessories is disclosed. The kilt hanger includes a frame defining two arms and three horizontal members. A kilt is folded into thirds or three panels and connected to the kilt hanger using a pair of clasps or clips on each horizontal member. Accordingly, each panel of the folded kilt is connected to a different horizontal member with a center panel of the kilt connected to a central horizontal member and each other panel connected to an outer horizontal member. The outer horizontal members are positioned higher on the arms than the central horizontal member. A vest and jacket can also be placed on the kilt hanger along with a fly plaid that is draped over an optional horizontal dowel member. Methods of using and fabricating the kilt hanger are also disclosed.

15 Claims, 6 Drawing Sheets

(56) References Cited

U.S. PATENT DOCUMENTS

| | | | | | |
|---|---|---|---|---|---|
| 4,324,352 | A | | 4/1982 | Goldfarb et al. | |
| 4,424,922 | A | | 1/1984 | Zuckerman et al. | |
| 4,878,276 | A | * | 11/1989 | Morrish et al. | 223/96 |
| 5,033,661 | A | * | 7/1991 | Baun | 223/88 |
| 5,040,707 | A | | 8/1991 | Ayano et al. | |
| 5,082,152 | A | * | 1/1992 | Chen | 223/85 |
| 5,113,554 | A | * | 5/1992 | Gallo et al. | 223/88 |
| 5,277,345 | A | * | 1/1994 | Ozaki | 223/85 |
| 5,402,558 | A | * | 4/1995 | Santapa | 223/91 |
| D365,448 | S | | 12/1995 | Travis et al. | |
| D371,460 | S | | 7/1996 | Ferguson | |
| 5,664,709 | A | | 9/1997 | Graham | |
| 5,975,384 | A | * | 11/1999 | Manabat | 223/91 |
| 6,170,679 | B1 | * | 1/2001 | Frye et al. | 211/113 |
| 6,250,523 | B1 | | 6/2001 | Louw | |
| 6,338,426 | B1 | | 1/2002 | Okiyama | |
| D498,936 | S | | 11/2004 | Gouldson | |
| D506,077 | S | | 6/2005 | Pluchino et al. | |
| 6,964,342 | B2 | * | 11/2005 | Wenzler | 211/45 |
| 2003/0015558 | A1 | | 1/2003 | Gouldson et al. | |

FOREIGN PATENT DOCUMENTS

| | | | | | |
|---|---|---|---|---|---|
| FR | 936026 | A | * | 7/1948 | A47G 25/18 |
| GB | 740306 | A | | 11/1955 | |
| JP | 10215999 | A | * | 8/1998 | A47G 25/18 |
| JP | 2000107013 | A | * | 4/2000 | A47G 25/50 |

* cited by examiner

FIG. 2
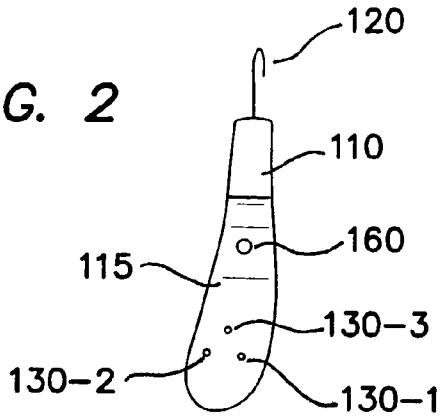
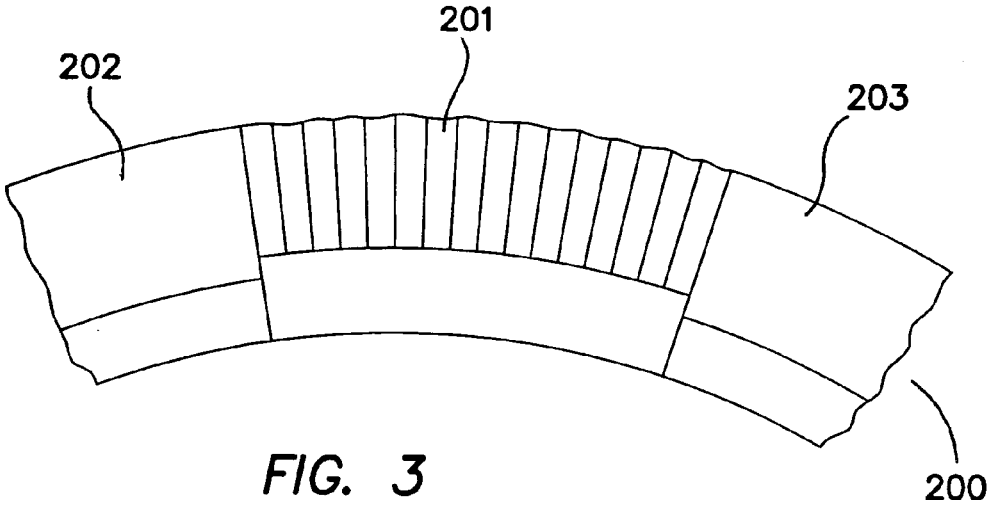
FIG. 3

KILT HANGER

FIELD OF THE INVENTION

The embodiments of the present invention relate to a hanger for kilts. More particularly, the embodiments relate to a kilt hanger, method of using the kilt hanger and a method of fabricating the kilt hanger.

BACKGROUND

Although their origin is sometimes disputed, kilts have been in existence for centuries. Like other garments, kilts have been stored and hanged using conventional hangers. Unfortunately, kilts are not like other garments and thus they have suffered from the inadequacies of conventional hangers. Using a conventional hanger results in a wrinkled, matted or otherwise disheveled kilt. Moreover, hanging a kilt and its accessories on one or more hangers can be difficult and cause the kilt accessories to be misplaced.

Thus, there exists a need for a single hanger for hanging a kilt to prevent wrinkling and matting and accommodating the kilt and its accessories.

SUMMARY

Accordingly, one apparatus embodiment of the present invention is a kilt hanger comprising: a frame member defining two frame arms; a hook member connected to said frame member; a group of three horizontal members extending between the first frame arm and the second frame arm, each of said three horizontal members supporting a pair of operable clasps.

A method of hanging a kilt according to one embodiment of the present invention comprises: folding a kilt into thirds forming three panels; suspending a first kilt panel from a first pair of clasps supported by a center horizontal member; and suspending a second and third kilt panel from a second and third pair of clasps supported by outer horizontal members.

A method of fabricating a kilt hanger comprising: forming a frame defining a first and second frame arm; crafting multiple cavities into said frame wherein a first cavity is on top surface of the frame and at least three cavities are on inner portions of the first and second arm; inserting a hook member into the first cavity; positioning a pair of clasps on each of three horizontal members; and inserting a first end of the three horizontal members into the three cavities in the first frame arm and inserting a second end of the three horizontal members into corresponding three cavities in the second frame arm.

Other variations, embodiments and features of the present invention will become evident from the following detailed description, drawings and claims.

BRIEF DESCRIPTION OF THE DRAWINGS

FIGS. 2 and 2A illustrate cross-sectional side views of the kilt hanger of FIG. 1;

FIG. 3 illustrates a traditional kilt in an open position;

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
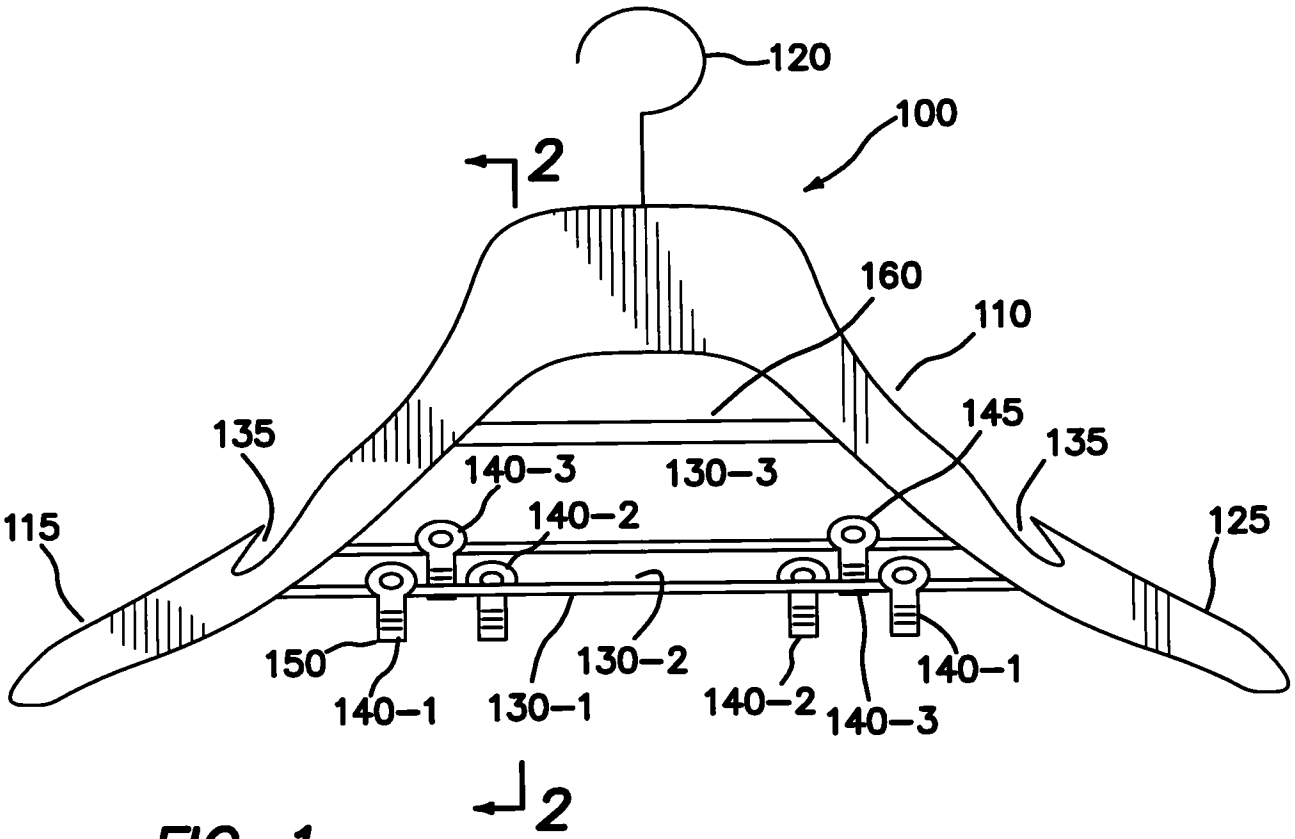
FIG. 1 illustrates a front view of a kilt hanger of the present invention.

Initial reference is made to FIG. 1 illustrating a front view of a kilt hanger generally identified by reference numeral 100. In a first embodiment, the kilt hanger 100 includes a frame 110, hook member 120 and three horizontal members 130-1 through 130-3. Each horizontal member 130-1 through 130-3 extends between a first frame arm 115 and a second frame arm 125 and supports a pair of clips or clasps 140-1 through 140-3. Other conventional connection means may be used as well. The horizontal members 130-1 through 130-3 insert through apertures (not shown) in the clasps 140-1 through 140-3. Depending on the requirements of the kilt hanger 100, the clasps 140 may be fixed on the horizontal members 130-1 through 130-3 or adjustable along the length of the horizontal members 130-1 through 130-3. The clasps 140-1 through 140-3 include two grips 145 which, when compressed, open a pair of pinchers 150 at an opposite end of the clasps 140-1 through 140-3. The pinchers 150 are ideally padded to prevent damage to an attached kilt 200 (shown in FIG. 3). The horizontal members 130-1 through 130-3 may be fabricated of wire, metal, plastic or any similar material. Optionally, a horizontal dowel member 160 extends between the first frame arm 115 and the second frame arm 125. The dowel member 160 is ideally made of wood but other rigid materials are suitable as well.

Figure 2A:
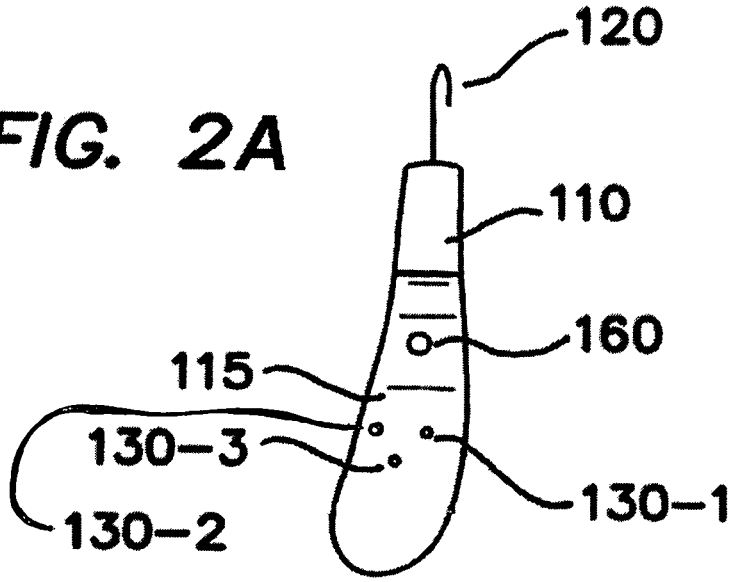

Now referring to FIGS. 2 and 2A, the respective vertical position of the horizontal members 130-1 through 130-3 is evident in the cross-sectional side view along A. The center horizontal member 130-3 is positioned slightly lower than the two outer horizontal members 130-1 and 130-2 (FIG. 2). In an alternative embodiment, the central horizontal member 130-3 is positioned slightly higher than the two outer horizontal members 130-1 and 130-2 (FIG. 2A). In either embodiment, the optional horizontal dowel member 160 is positioned higher on the arms 115, 125 than the center horizontal member 130-3 and pair of outer horizontal members 130-1 and 130-2. Also evident in FIGS. 2 and 2A is the widening of the frame arms 115, 125 to accommodate the spaced horizontal members 130-1 through 130-3.

Figure 4:
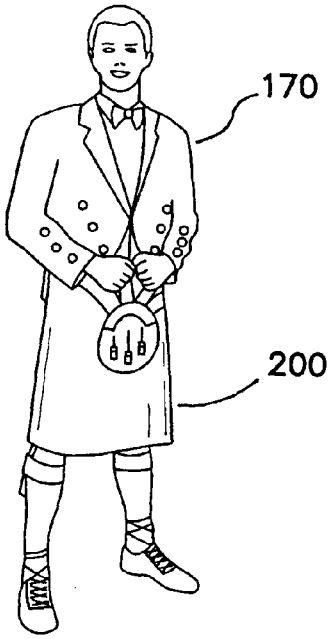
FIG. 4 illustrates a kilt jacket being worn with a kilt.
Figure 5:
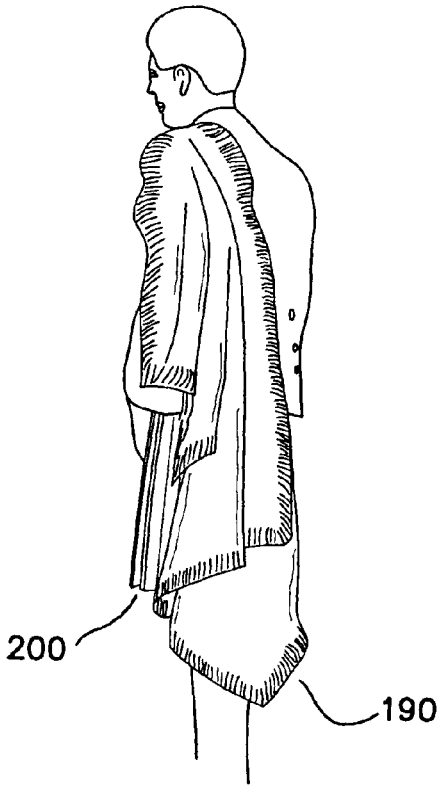
FIG. 5 illustrates a fly plaid being worn with a kilt.
Figure 6:
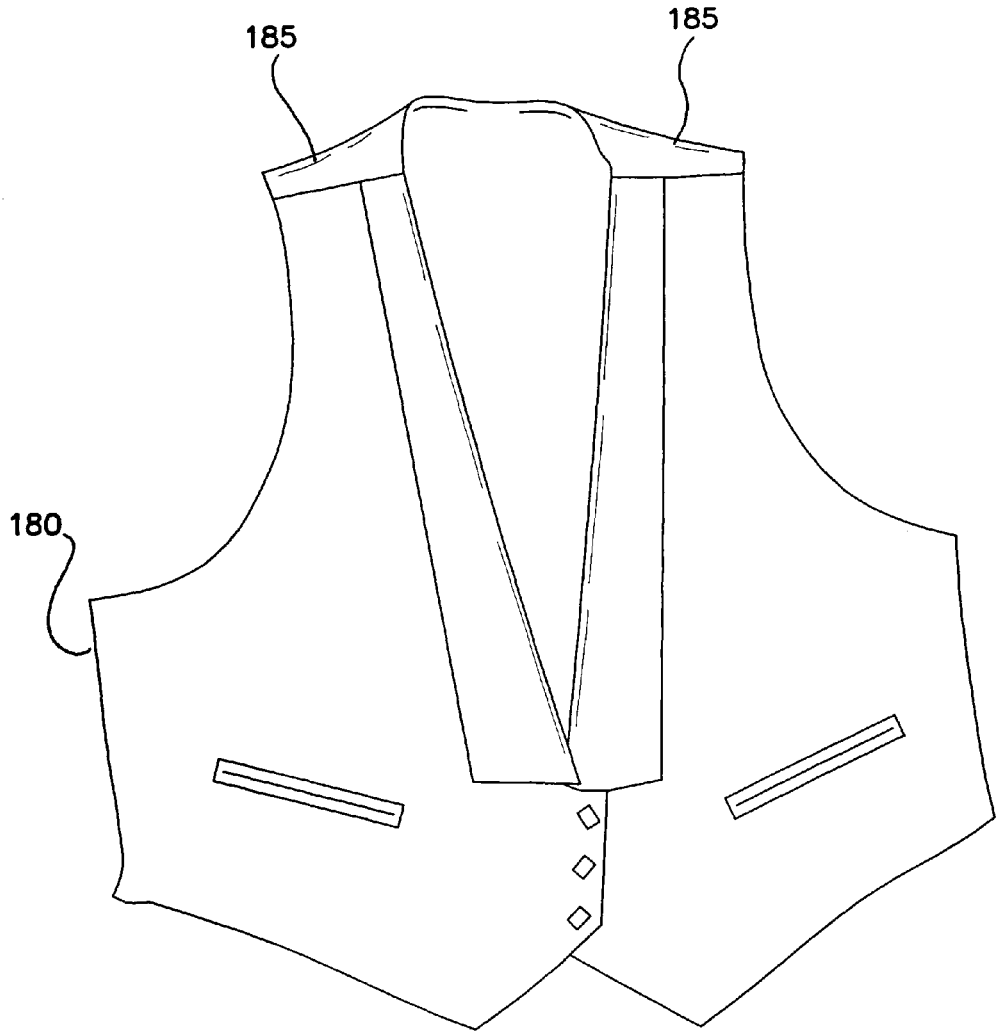
FIG. 6 illustrates a kilt vest.

Ideally, the frame 110 is fabricated of wood, but it can be made of plastic, aluminum, resin, composite or similar materials. The frame 110 is shaped to support and fill out a kilt jacket 170 (shown in FIG. 4). The frame 110 further includes a notch 135 in each arm 115, 125. The pair of notches 135 are suitable for supporting of a kilt vest 180 (shown in FIG. 6). An upper edge of the frame arms 115, 125 and the horizontal dowel member 160 may be coated in a latex, rubber or other non-slip material to prevent garments, namely the jacket 170 and fly plaid 190 (shown in FIG. 5), from slipping off the frame 110 and horizontal dowel member 160, respectively.

In practice, the kilt hanger 100 accommodates the kilt 200, kilt jacket 170, kilt vest 180 and fly plaid 190. Now referring to FIG. 3, to hang the kilt 200, the kilt is first folded into thirds such that panel 201 is sandwiched between panels 202 and 203. Then, the folded kilt 200 is connected to the kilt hanger 100 by using the clasps 140-1 on the center horizontal member 130-1. The clasps 140-1 are attached to a waist area or top side of the kilt 200. Then, clasps 140-2 and 140-3 are attached to panels 202, 203 in the same manner. Therefore, each panel 201 through 203 is independently attached to the kilt hanger 100. Next, the fly plaid 190 is draped over the horizontal dowel member 160. Once the kilt 200 and fly plaid 190 are in place, the vest 180 can be positioned over the frame arms 115, 125 such that shoulders 185 of the vest 180 are retained by notches 135 and the jacket 170 is draped over the frame arms 115, 125 in a conventional manner. The conventional swivel, hook member 120 is then used to place the kilt hanger 100 on a hanger bar, rod or other suitable rigid member or the entire ensemble on the kilt hanger 100 may be first placed in a garment bag for travel.

Figure 8:
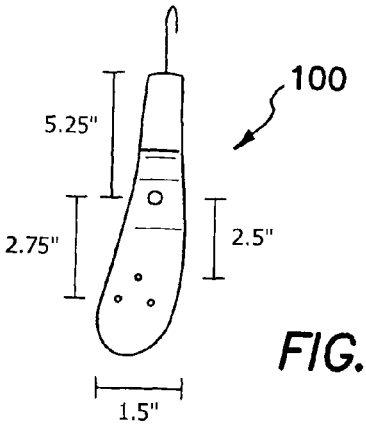
FIG. 8 illustrates a side view of the kilt hanger with representative dimensions.
Figure 7:
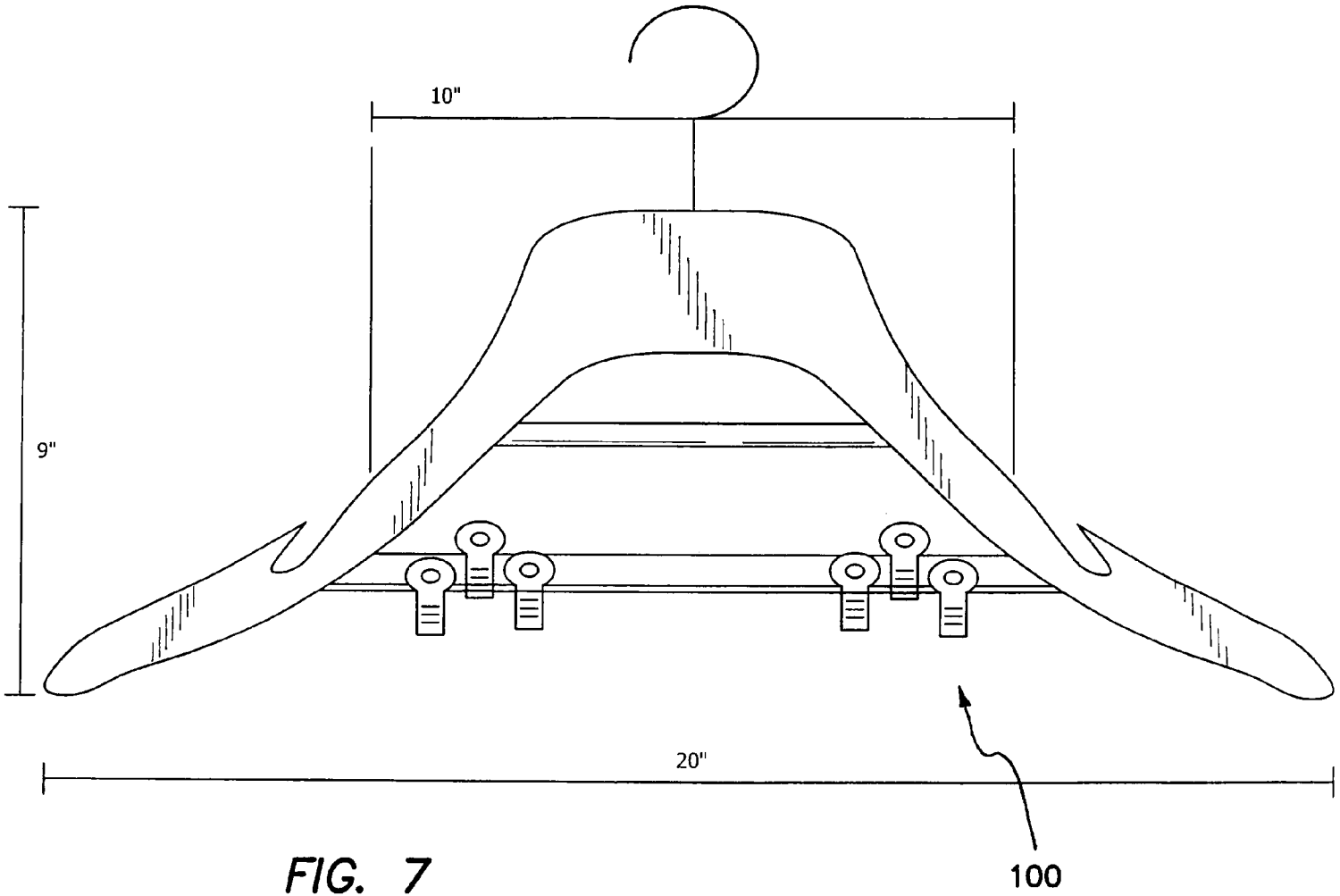
FIG. 7 illustrates a front view of the kilt hanger with representative dimensions.

In one specific embodiment, the kilt hanger 100 has the dimensions set forth in FIGS. 7-8. However, it will be understood by those skilled in the art that the kilt hanger 100 may be designed and fabricated with any suitable dimensions.

With the kilt hanger embodiments of the present invention, the kilt 200 may be properly stored along with the kilt accessories. In this manner, a wearer enjoys a fresh looking kilt and accessories which are ready for wear at any time including immediately after travel.

In one embodiment, fabricating the kilt hanger is accomplished by forming the frame defining two arms. The frame may be formed of wood, metal or plastic. Multiple cavities are then drilled or otherwise crafted in the frame. The cavities are positioned such that they accommodate the inserted hook member 120, horizontal members 130-1 through 130-3 and the horizontal dowel member 160. Prior to inserting the horizontal members 130-1 through 130-3, the pairs of clasps 140-1 through 140-3 are placed on each horizontal member 130-1 through 130-3. The horizontal members 130-1 through 130-3 and horizontal dowel member 160 may held in place by the arms 115, 125 and/or may be secured using glue, epoxy or other adhesive.

Although the invention has been described in detail with reference to several embodiments, additional variations and modifications exist within the scope and spirit of the invention as described and defined in the following claims.

I claim:

1. A kilt hanger comprising:

a frame member defining two fixed frame arms, each of said two fixed frame arms extending downward and outward from one another to an lower most point of said kilt hanger;

a hook member connected to said frame member; and a group of three horizontal members extending between the first fixed frame arm and the second fixed frame arm at a point where said first fixed frame arm and second fixed frame arm are extending downward and outward from one another and excluding a lower most point of each of said two fixed frame arms, each of said three, separate, horizontal members individually and directly fixed at a first end to said first fixed frame arm and a second end to said second fixed framed arm such that positions of said three horizontal members are permanently fixed relative to said frame member, each of said horizontal members fixed to the frame arms above a lower most portion of the frame arms, each of said three horizontal members supporting a pair of operable clasps, and wherein first and second horizontal members are spaced from one another in a same horizontal plane and a third horizontal member is spaced vertically from the two horizontal members in a vertical plane which passes between the first and second horizontal members such that a distance traversed horizontally by said first and second horizontal members differs from a distance traversed by said third horizontal member.

2. The kilt hanger of claim 1 further comprising a horizontal dowel member extending between said first frame arm and second frame arm.

3. The kilt hanger of claim 2 wherein said horizontal dowel member is positioned higher on the arms than said three horizontal members.

4. The kilt hanger of claim 2 wherein an upper surface of the horizontal dowel member is coated with a non-slip material.

5. The kilt hanger of claim 1 wherein the three horizontal members comprise a central horizontal member and a pair of outer horizontal members.

6. The kilt hanger of claim 5 wherein the pair of outer horizontal members are positioned higher on the arms than the central horizontal member such that the pair of outer horizontal members are nearer to the hook member than the central horizontal member.

7. The kilt hanger of claim 5 wherein the pair of outer horizontal members are positioned lower on the arms than the central horizontal member such that the pair of outer horizontal members are farther from the hook member than the central horizontal member.

8. The kilt hanger of claim 1 wherein each pair of clasps is adjustable along a length of the horizontal member on which the pair of clasps is supported.

9. The kilt hanger of claim 1 wherein upper surfaces of the frame arms are coated with a non-slip material.

10. The kilt hanger of claim 1 wherein the arms taper as they extend downward.

11. A kilt hanger comprising:

a frame member defining two fixed frame arms, each of said two fixed frame arms extending downward and outward from one another to an lower most point of said kilt hanger;

a hook member extending upward from said frame member;

a group of three horizontal members extending between the first fixed frame arm and the second fixed frame arm at a point where said first fixed frame arm and second fixed frame arm are extending downward and outward from one another and excluding a lower most point of each of said two fixed frame arms, each of said three, separate, horizontal members individually and directly fixed at a first end to said first fixed frame arm and a second end to said second fixed framed arm such that positions of said three horizontal members are permanently fixed relative to said frame member, each of said horizontal members fixed to the frame arms above a lower most portion of the frame arms, each of said three horizontal members supporting a pair of operable clips, and wherein first and second horizontal members are spaced from one another in a same horizontal plane and a third horizontal member is spaced vertically from the two horizontal members in a vertical plane which passes between the first and second horizontal members such that a distance traversed horizontally by said first and second horizontal members differs from a distance traversed by said third horizontal member; and a horizontal dowel member extending between the first frame arm and the second frame arm, said horizontal dowel member positioned higher on the arms than said three horizontal members such that said horizontal dowel member is nearer to the hook member than the central horizontal member.

12. The kilt hanger of claim 11 wherein an upper surface of the horizontal dowel member is coated with a non-slip material.

13. The kilt hanger of claim 11 wherein the three horizontal members comprise a central horizontal member and a pair of outer horizontal members.

14. The kilt hanger of claim 11 wherein each pair of clips is adjustable along a length of the horizontal member on which the pair of clips is supported.

15. The kilt hanger of claim 11 wherein the arms are wider near a bottom portion than a top portion.

* * * * *